United States Patent [19]

Mueller et al.

[11] 4,332,141

[45] Jun. 1, 1982

[54] DEFROST CONTROL SYSTEM FOR REFRIGERATION SYSTEM

[75] Inventors: Dale A. Mueller, St. Paul; Robert T. Ruminsky, Bloomington; Stephen L. Serber, New Hope; Rodger C. Wolfgram, Burnsville, all of Minn.

[73] Assignee: Honeywell Inc., Minneapolis, Minn.

[21] Appl. No.: 181,265

[22] Filed: Aug. 25, 1980

[51] Int. Cl.[3] ..... F25D 21/02

[52] U.S. Cl. ..... 62/140; 62/155

[58] Field of Search ..... 62/140, 151, 128, 155, 62/234; 165/17

[56] References Cited

U.S. PATENT DOCUMENTS

| | | | |
|---|---|---|---|
| 3,077,747 | 2/1963 | Johnson, Jr. | 62/140 |
| 3,374,643 | 3/1968 | Thorner | 62/140 |
| 3,377,817 | 4/1968 | Petranek | 62/140 |
| 3,461,681 | 8/1969 | Smith et al. | 62/155 |
| 3,479,836 | 11/1969 | McHale | 62/140 |
| 3,826,103 | 7/1974 | Grover | 62/140 |
| 4,248,052 | 2/1981 | Bechtel | 62/140 |

*Primary Examiner*—Albert J. Makay
*Assistant Examiner*—Harry Tanner
*Attorney, Agent, or Firm*—Roger W. Jensen

[57] ABSTRACT

A control system for a refrigeration system for controlling the defrosting of one of the heat exchange coils thereof; the control system comprising a nozzle element positioned adjacent to one side of the evaporator coil at a point where frost may build up on the evaporator coil; compressed air means connected to the nozzle through valve means and controllable to selectively permit air to be discharged from a nozzle against the coil; air flow sensor means positioned on the other side of the evaporator coil in register with a nozzle, the sensor means including switch means adapted to be actuated upon said sensor being impacted by a stream of air; and controller means adapted to periodically actuate the valve means so as to cause periodic pulses of air to flow from the nozzle through the evaporator coil, said controller further functioning to place the system into a defrost mode of operation upon said sensor switch means being unactuated for a period of time exceeding the cycle period of the actuation of the valve means.

2 Claims, 4 Drawing Figures

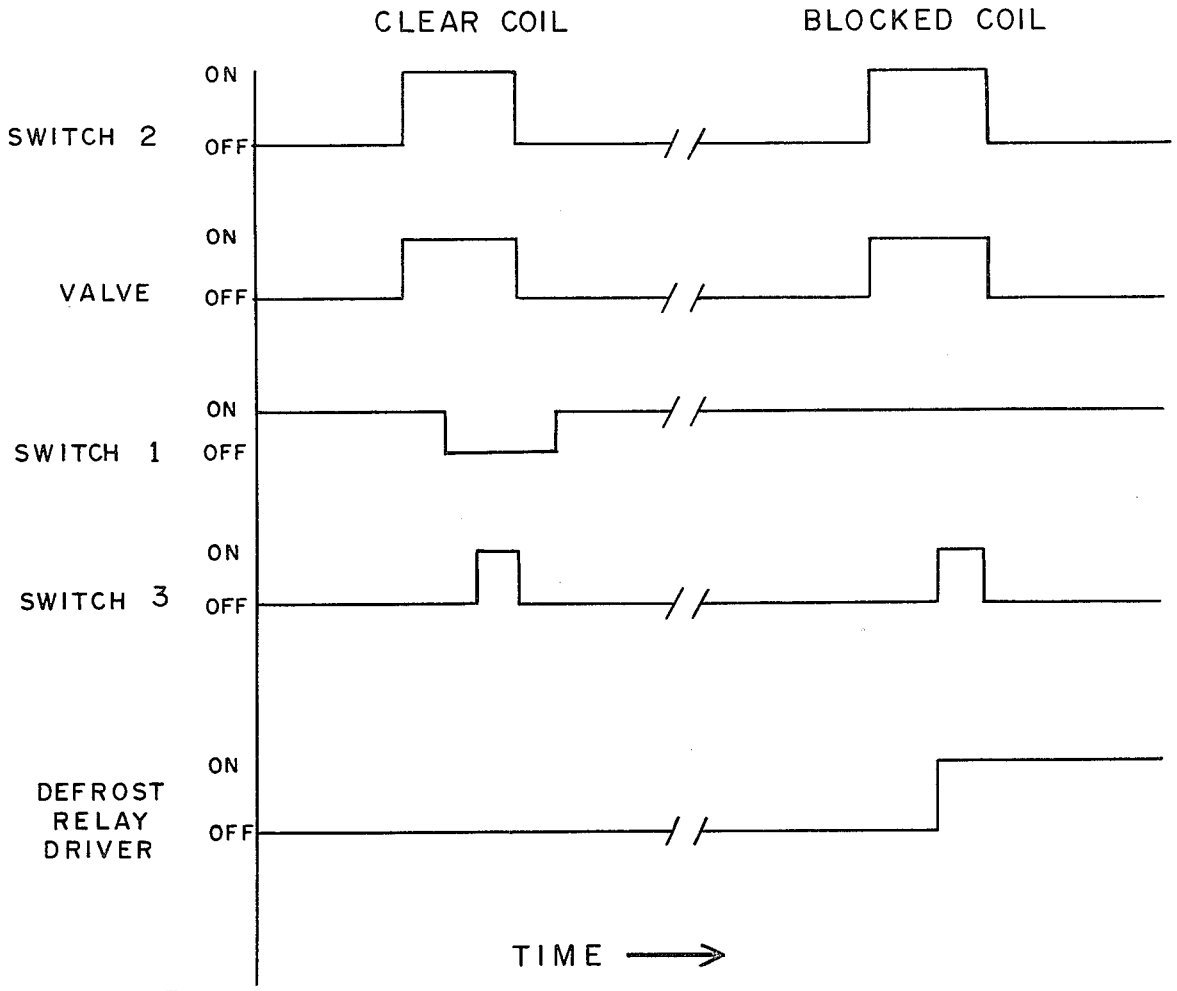
FIG. 3
FIG. 2
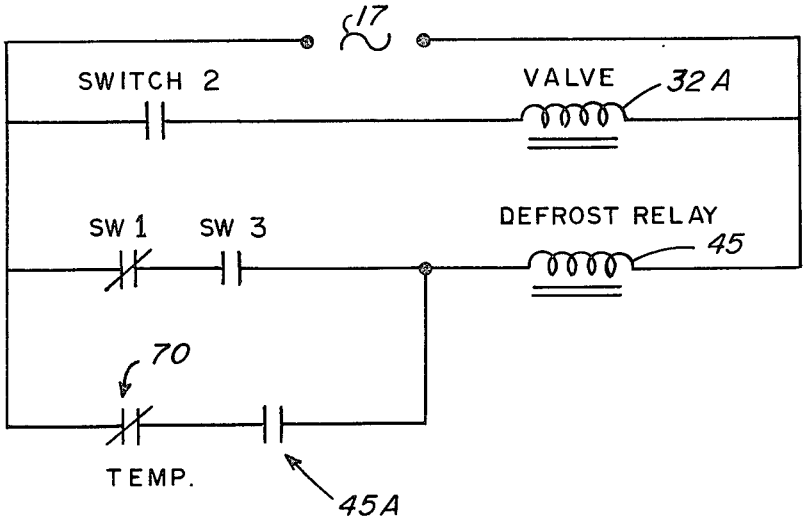

DEFROST CONTROL SYSTEM FOR REFRIGERATION SYSTEM

BACKGROUND OF THE INVENTION

A vexing problem with refrigeration systems is that, under some circumstances, the evaporator coil will have frost accumulate thereon and as the frost thickness increases, the overall efficiency of the system decreases dramatically, energy is wasted and the cost of operating the system increases significantly. The problem is especially acute in the case of heat pumps and commercial refrigeration units; accordingly, many schemes have heretofore been proposed for detecting the frost and for taking corrective action for removing the frost from the outdoor coil. Examples of prior art systems include U.S. Pat. Nos. 3,170,304; 3,170,305; 3,400,553; and 4,209,994.

Our invention comprises an improved apparatus for detecting a frost build up on the evaporator coil of a refrigeration system and for initiating defrost of the system when the frost has accumulated to a preselected magnitude.

SUMMARY OF THE INVENTION

The present invention is a defrost control system for a reverse cycle refrigeration system comprising refrigerant compression means, a condensor coil, an evaporator coil, and refrigerant conduit means interconnecting the compression means and the coils. In particular, the defrost system comprises a nozzle element positioned adjacent to one side of the evaporator coil at a point or location where frost may build up on the evaporator coil. Further, the defrost control system includes gaseous fluid pressure means connected to the nozzle by valve means controllable to selectively permit gaseous fluid to be discharged from said nozzle against said one side of the coil and thence through the coil (to the extent permitted by frost which may have built up on the evaporator coil). The control system further includes a fluid flow sensor means positioned on the other side of the coil in register with the nozzle, the sensor including switch means adapted to be actuated upon the sensor being impacted by a stream of gaseous fluid. Finally, the control system includes a controller means having operative connections to the main refrigeration system, said sensor switch means, and to said valve means, the controller means being characterized by being adapted to selectively actuate the valve means so as to cause gaseous fluid to flow from said nozzle through said evaporator coil, and said controller means further functioning to place the system into a defrost mode of operation upon said sensor switch means being unactuated following the actuation of the valve means. Once the defrost mode of operation has been commanded by the controller, then the controller is further characterized by functioning to terminate the defrosting of the system upon said sensor switch means being actuated following the actuation of said valve means.

BRIEF DESCRIPTION OF THE DRAWINGS

FIG. 2 is a schematic wiring diagram of the means for controlling the valve and for initiating the defrost of the refrigeration system.

FIG. 3 is a time function chart showing the functioning of the apparatus depicted in FIG. 2 as a function of whether or not the evaporator coil is free of frost, i.e., "clear" or is "blocked" with frost.

DESCRIPTION OF THE PREFERRED EMBODIMENT

Figure 1:
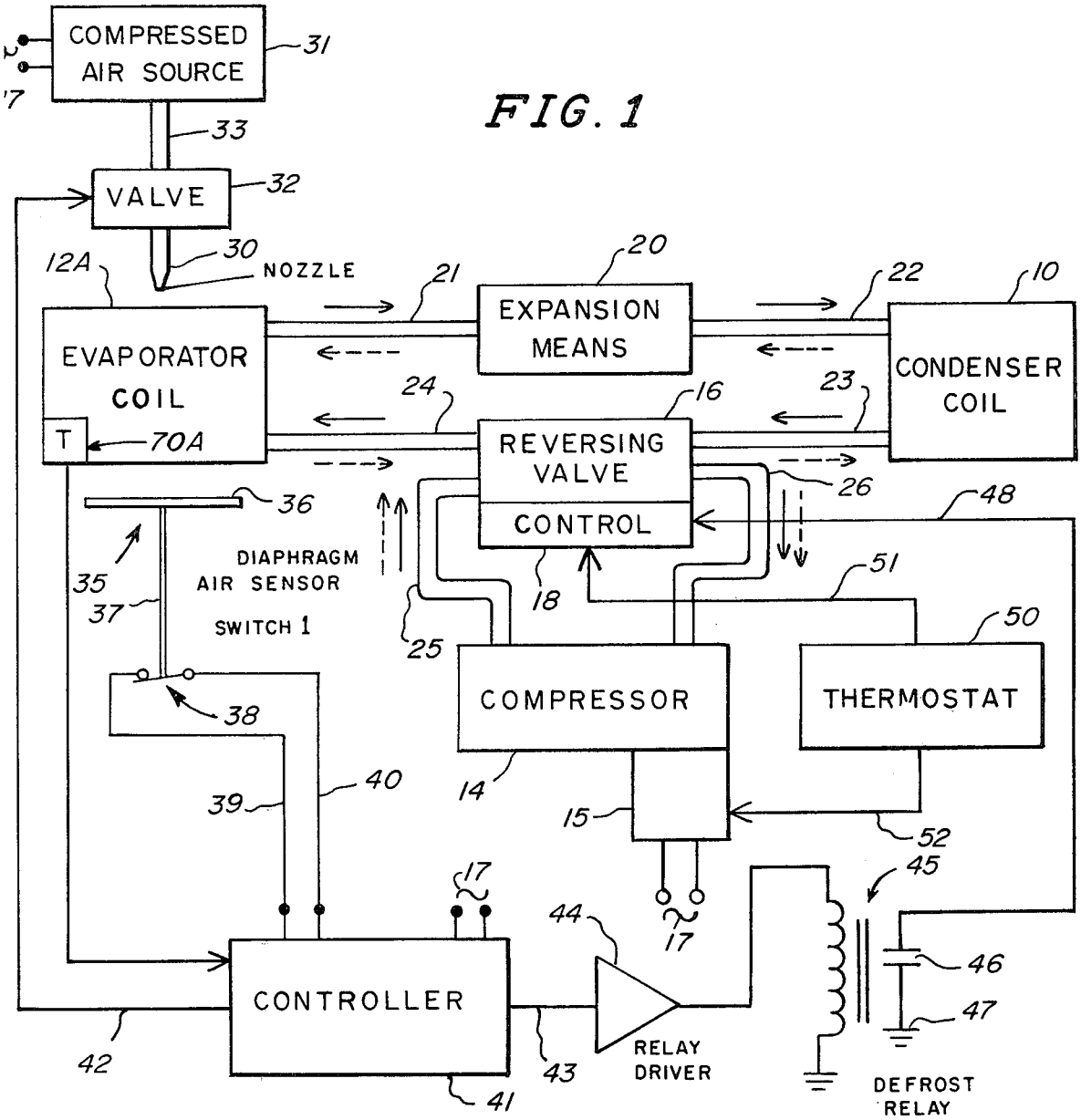
FIG. 1 of the drawings is a block/schematic diagram of a reverse cycle refrigeration system embodying the present invention.

Referring to the drawing, a reverse cycle refrigeration system is depicted comprising a condensor coil 10, an evaporator coil 12, a refrigerant conduit means interconnecting the coils and the compressor, the refrigerant conduit means including a reversing valve 16 having a control 18, an expansion means 20, and appropriate interconnecting piping 21–26. The compressor 14 has a controller 15 energized by a suitable power supply 17. The system as thus far described is old in the art and is exemplified by the above identified patents; e.g., 3,170,304. Briefly, during the cooling mode, i.e., when the refrigeration system is working to heat a space, compressor 14 will discharge relatively hot gaseous refrigerant through pipe 25, reversing valve 16 and pipe 23 to the condenser coil 10. The temperature of the refrigerant passing through the evaporator coil 12 is relatively cold; this will chill the evaportor coil and thereby set up the possibility of frost forming thereon, the rate of frost build up being a function of ambient air temperature, the level of humidity in the ambient air, and the temperature of the refrigerant passing through the evaporator coil. During the defrost mode the reversing valve 16 is operated so that the hot gaseous refrigerant from the compressor is routed by a pipe 25, reversing valve 16 and pipe 24 to the evaporator coil 12.

The evaporator coil 12 has one side or surface thereof identified by the reference designator 12A so as to signify a surface on and/or adjacent to which frost may build up during the operation. A nozzle 30 is positioned adjacent to side 12A of the evaporator coil 12 at a point where frost may build up on and/or adjacent to the evaporator coil. The defrost control system further comprises a gaseous fluid pressure means, e.g., a source of compressed air 31 energized suitably as at 17 and connected via conduit 33 to a valve 32 and thence to nozzle 30, valve 32 being selectively controlled so as to permit the compressed air to flow out of nozzle 30 against side 12A of the evaporator coil 12 and thence through the coil 12, to the extent permitted by frost which may be present on and within the coil structure. On the opposite side of the evaporator coil 12 is an air flow sensor means designated by the reference numeral 35 comprising a diaphragm 36 adapted to be impacted by air eminating from nozzle 30 and passing through the coil 12. The diaphragm is linked by a connected 37 to an electric switch means 38 also identified in FIG. 1 as switch 1, this switch means being a normally closed single pole switch connected by leads 39 and 40 to a controller 41, also suitably energized as at 17. The controller has a first output 42 connected to the valve 32 and a second output 43 connected to a relay driver or amplifier 44. The output from the relay driver is connected to the coil of a defrost relay 45 having a pair of normally opened contacts 46 connected between ground 47 and the control means 18 for the reversing valve 16.

The system further includes a thermostat 50 having a first output connected through lead 51 to the control 18 and a second output connected through lead 52 to the control 15 for the compressor 14.

A suitable thermostat that may be used as a component in the system depicted is the Honeywell Inc. Model T872, a bimetal operated mercury switch for heating-cooling and including switch means for controlling a plurality of auxiliary heating means. The Westinghouse Company HI-RE-LI unit comprising an outdoor unit model No. HL036COW and indoor unit AG012HOK may be used as an appropriate heat pump.

In operation when thermostat 50 calls for operation of the refrigeration system, this will result in a control signal being applied via lead 52 to the controller 15 of the compressor 14 so as to permit compressed refrigerant to be applied, either to the evaporator coil 10 or the condensor coil 12 depending upon the mode of operation. If the system is in the space heating mode, then the hot gaseous refrigerant will be, as indicated above, directed through the reversing valve 16 so as to flow to the condenser coil 10, and thus relatively cold gaseous refrigerant and/or liquid refrigerant will flow through the evaporator coil 12.

Figure 4:
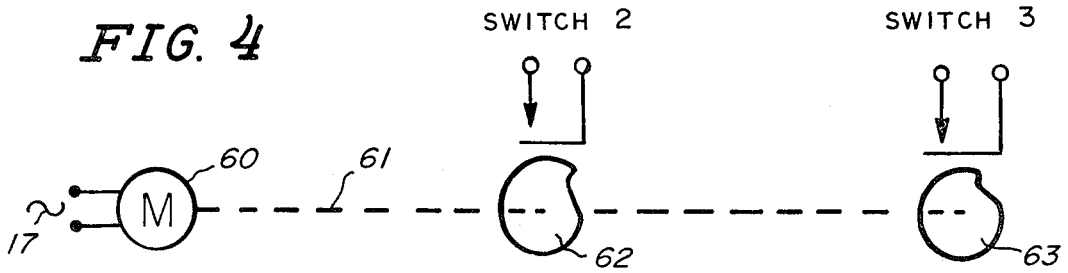
FIG. 4 is a schematic showing a motor driven cam arrangement within a controller means for periodically actuating switches depicted as switch 2 and switch 3.

The controller 41 comprises two more switches identified in FIG. 4 as switch 2 and switch 3; FIG. 4 also shows schematically a motor means 60 energized by a suitable source 17 and having an output 61 used to drive a pair of cams 62 and 63 which cause respectively the closing of the contacts of the normally open switch means, switch 2 and switch 3. Switches 2 and 3 are also depicted in FIG. 2, together with the other apparatus, including the coil 32A for valve 32 and the defrost relay 45. Normally open switch 2 is connected in series with valve winding 32A and the series combination is connected to a source of suitable energization 17. Thus when switch 2 is closed, then valve winding 32A is energized permitted compressed air to flow through the valve and to the nozzle 30 so as to be expelled against the side 12A of the evaporator coil 12. Also across power supply 17 is connected to normally closed switch 1 in series with normally open switch 3 and thence in series with the winding of the defrost relay 45. Referring to FIG. 3, the relationship of the energization of valve 32 and the closing of switch 2 is clearly shown. On the left-hand side of FIG. 3 are conditions present when the coil 12 is clear or free of frost. Thus, at the top of FIG. 3, on the left-hand side, it will be noted that switch 2 goes from an off condition to an on condition and then back to an off condition as a function of time, this corresponds to the cam 62 driven by motor 60 periodically closing the normally open contacts of switch 2. Almost simultaneously, in the representation of FIG. 3, the valve follows from an off mode to an on mode. As long as the evaporator coil is clear or free of frost, then the switch 1, actuated by the diaphragm sensor 36, will change from its normally closed state to an open or "off" condition, although there is a slight time lag (see FIG. 3) between the operation of the valve 32 and the actuation of switch 1. The cam 63 4 is arranged so that the normally open switch contacts of switch 3 are closed during part of the time that switch 1 is off. As long as switch 3 and switch 1 are never on at the same time, then the defrost relay 45 cannot be actuated. This is depicted in the left-hand side of FIG. 3 or the clear coil case. However, if the coil is blocked with ice or frost, then it will be noted on the right-hand side of FIG. 3 that switch 1 is always in the on mode of operation because the air from the nozzle 30 is not permitted to impact on the air sensor 35 so as to operate the switch 1. Thus, on the right-hand side of FIG. 3, it will be noted that switch 1 is on continuously. Thus, when switch 3 comes on, then the defrost relay winding 45 is energized which functions instantaneously to close a pair of holding contacts 45A which are in series with the winding 45 and a set of normally closed contacts 70; this functions to maintain energization of the defrost relay 45. The normally closed contacts 70 are physically associated with and operated by a thermostat 70A which is integral with or adjacent to the evaporator coil 12 and functions to measure the temperature of the evaporator coil and is adapted, upon the temperature of the evaporator coil rising to a preselected value, to cause the normally closed contacts 70 to open.

Thus in operation, if the evaporator coil loads up or builds up with frost and ice so that air from valve 32 and nozzle 30 is not permitted to flow through the evaporator coil 12, then the diaphragm 36 will not be displaced and accordingly switch 1 will not be displaced from its normally closed or on position. This, as explained above, will then permit the subsequent closing of switch 3 to initiate a defrost mode of operation of the refrigeration system. This will direct hot refrigerant from the compressor 14 to the evaporator coil 12 so as to elevate the temperature of the coil 12 and to melt away accumulated frost and ice. Thermostat 70A will be set so that the contacts 70 open up at a temperature corresponding to the frost having been dispelled/eliminated. Concurrently (once the frost has been eliminated) then the periodic pulses of air from the nozzle 30 will once again be able to pass through the evaporator coil 12 so as to impact on the diaphragm 36 and through the linkage 37 periodically open the contacts on switch 1. In this manner the energization to the defrost relay 45 is interrupted and the system is once again reversed from the defrost mode of operation back to the normal mode of operation.

While we have described a preferred emodiment of the invention, it will be understood that the invention is limited only by the scope of the following claims:

We claim:

1. An evaporator coil defrost control system (hereinafter "defrost control system") for a refrigeration system (hereinafter "system") wherein said refrigeration system comprises refrigerant compression means, a condenser coil, an evaporator coil, and refrigerant conduit means connecting said coils, said defrost control system comprising:

a nozzle element positioned adjacent to one side of said evaporator coil at a point where frost may build on said evaporator coil;

compressed air means connected to said nozzle via valve means controllable to selectively permit air to be discharged from said nozzle element against said coil;

an air flow sensor positioned on the other side of said evaporator coil in register with said nozzle, said sensor including switch means adapted to be actuated upon said sensor being impacted by a stream of air; and controller means having operative connections to said system, said sensor switch means, and to said valve means, said controller means being adapted to periodically actuate said valve means so as to cause periodic pulses of air to flow from said nozzle through said evaporator coil, and said controller further functioning to place said system into a defrost mode of operation upon said sensor switch

2. Apparatus of claim 1 further characterized by said controller functioning to terminate the defrosting of said system upon said sensor switch means being actuated following the actuation of said valve means.

* * * * *

UNITED STATES PATENT OFFICE

CERTIFICATE OF CORRECTION

PATENT NO. : 4,332,141

DATED : June 1, 1982

INVENTOR(S) : Dale A. Mueller, Robert T. Ruminsky, Stephen L. Serber and Rodger C. Wolfgram It is certified that error appears in the above-identified patent and that said Letters Patent are hereby corrected as shown below:

Column 4, line 63, after "sensor switch" insert --means being unactuated for a period of time exceeding the cycle period of the actuation of said valve means.--

Signed and Sealed this

*Fourteenth* Day of *September 1982*

[SEAL]

*Attest:*

GERALD J. MOSSINGHOFF

*Attesting Officer*

*Commissioner of Patents and Trademarks*